US006345471B1

(12) United States Patent
Gyllenhammar

(10) Patent No.: US 6,345,471 B1
(45) Date of Patent: Feb. 12, 2002

(54) EXPANDABLE, MOBILE ACCOMMODATION OF ACTIVITIES

(75) Inventor: Thorbjörn Gyllenhammar, Stockholm (SE)

(73) Assignee: Innovation Development Enterprise i Stockholm AB, Stockholm (SE)

( * ) Notice: Subject to any disclaimer, the term of this patent is extended or adjusted under 35 U.S.C. 154(b) by 0 days.

(21) Appl. No.: 09/423,940

(22) PCT Filed: May 15, 1998

(86) PCT No.: PCT/SE98/00927

§ 371 Date: Dec. 2, 1999

§ 102(e) Date: Dec. 2, 1999

(87) PCT Pub. No.: WO98/51875

PCT Pub. Date: Nov. 19, 1998

(30) Foreign Application Priority Data

May 15, 1997 (SE) ..... 9701818

(51) Int. Cl.[7] ..... E04B 1/344

(52) U.S. Cl. ..... 52/69; 52/66; 52/71; 296/26.02; 296/26.07; 296/169

(58) Field of Search ..... 52/64, 66, 67, 52/69, 71; 135/88.01; 296/169, 172, 173, 174, 26.02, 26.03, 26.07

(56) References Cited

U.S. PATENT DOCUMENTS

| | | | | | |
|---|---|---|---|---|---|
| 1,596,924 | A | * | 8/1926 | Curtis | 296/169 X |
| 2,167,557 | A | * | 7/1939 | Stout | 52/66 X |
| 2,890,907 | A | * | 6/1959 | Briskie et al. | 52/67 X |
| 3,271,065 | A | * | 9/1966 | Scuris | |
| 3,701,561 | A | * | 10/1972 | Friesen | 52/67 X |
| 4,135,755 | A | * | 1/1979 | Steffens | 296/26.07 X |
| 4,918,772 | A | * | 4/1990 | Haile | 296/169 X |

FOREIGN PATENT DOCUMENTS

| | | | |
|---|---|---|---|
| RU | 2004724 C1 | | 12/1993 |
| RU | 2004724 | * | 12/1993 |
| WO | WO 86/05829 | | 10/1986 |
| WO | WO 86/05829 | * | 12/1993 |
| WO | WO 96/13402 | | 10/1996 |

* cited by examiner

*Primary Examiner*—Winnie S. Yip
(74) *Attorney, Agent, or Firm*—Frishauf, Holtz, Goodman, Langer & Chick, P.C.

(57) ABSTRACT

The invention relates to an expandable mobile accommodation structure comprising a central structure provided with floor (3), roof (2), and end walls (1) and two longitudinal side walls (7), at least one of which is movable outwards together with outwardly pivotal floor and roof sections (4 and 9, resp.). The roof and floor sections comprise a rigid panel, and are pivoted to the side wall (7) and the floor and roof edges of the central structure such that in a non-expanded state the roof panel (9) and the side wall (7) are permitted to hang down double-folded outside the folded up floor panel (4). The invention is characterized in that an actuating means (14, 14') is arranged to act between the central structure and the roof panel (9) for swinging the roof panel up and down supported by a draw rope (15) is acting between the upper part of the central structure and the outermost part of the floor panel (4).

9 Claims, 4 Drawing Sheets

EXPANDABLE, MOBILE ACCOMMODATION OF ACTIVITIES

BACKGROUND OF THE INVENTION

The present invention relates to an expandable, mobile accommodation structure.

Expandable, mobile accommodation structures are known in different shapes and different varieties. In most cases, there are one or more hinges to be detached in connection with a change from an expanded to a non-expanded state, which involves complications and the risk of near-accidents. This can be avoided, as disclosed by e.g. the Swedish patent SE9403670. In that case, however, the roof and floor of the expandable part of the accommodation structure have to comprise each at least two folding sections. Such a design is suitable for large units. But for smaller units there is a need of a more simple design.

OBJECT OF THE INVENTION

The object of the present invention is to bring about an expandable, mobile accommodation structure which very simply and rapidly can be changed between expanded and non-expanded states.

This has been obtained according to the invention with an arrangement having the characteristics features set forth in the claims appended hereto. The change between expanded and non-expanded states is managed quite automatically and with complete control of the two movable panels and the movable side wall, and in the non-expanded state the total wall thickness on both sides is increased only with the thickness of the two panels and the side wall.

Since the weight of the movable parts may make them heavy to lift and retard, one or a pair of gas spring means may be provided. In certain cases it is more appropriate to use actuating means in the shape of hydraulic or pneumatic cylinders or a screw or crank mechanism.

The invention will now be described in more detail with reference to the attached drawings which schematically show an example of an embodiment of an accommodation structure in accordance with the invention.

DETAILED DESCRIPTION

Figure 1:
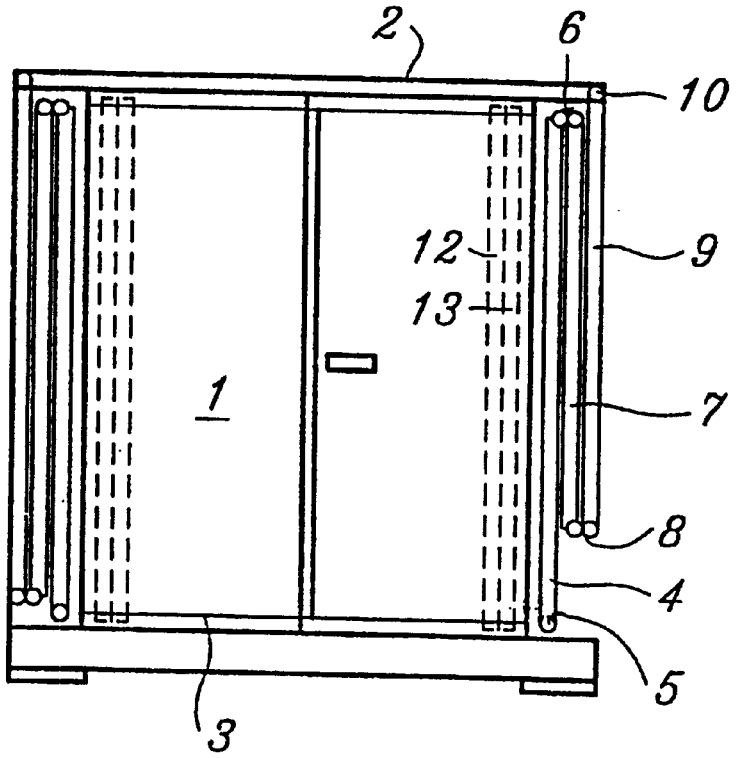
FIGS. 1–6 are end views of the accommodation structure during the expanding operation from a non-expanded state via different steps to a completely expanded state.

FIG. 1 discloses one of the end walls 1, the roof 2, the floor 3 of the central structure, and on each side a floor panel 4, which by a hinge 5 is connected to the longitudinal edge of the floor 3, and by a hinge 6 is connected to longitudinal side wall 7. This side wall is in turn connected by a hinge 8 to a roof panel 9, which by a hinge 10 is connected to an edge of the roof of the central structure.

Figure 2:
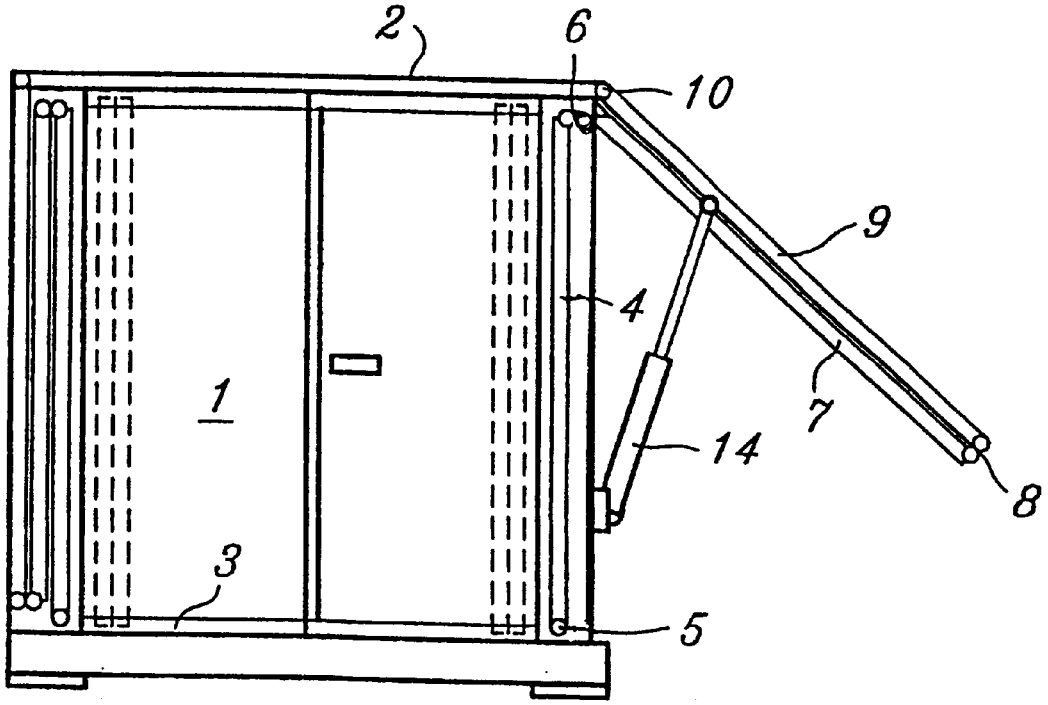
Figure 3:
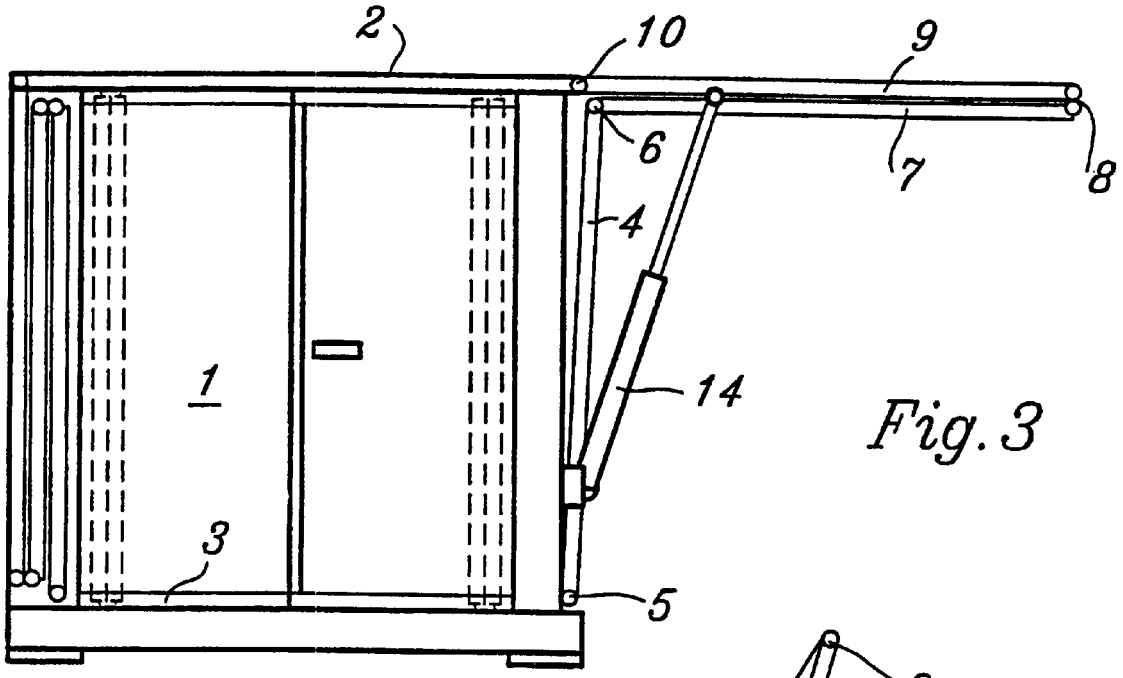
Figure 4:
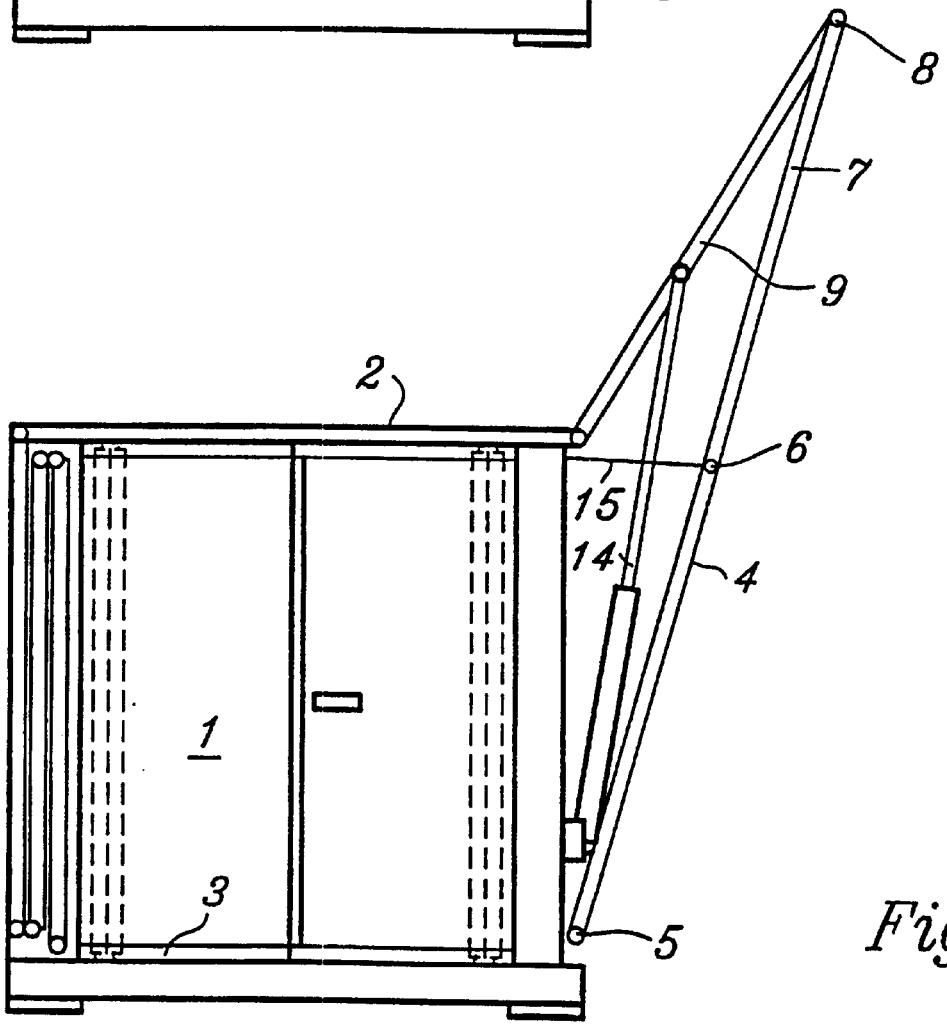
Figure 5:
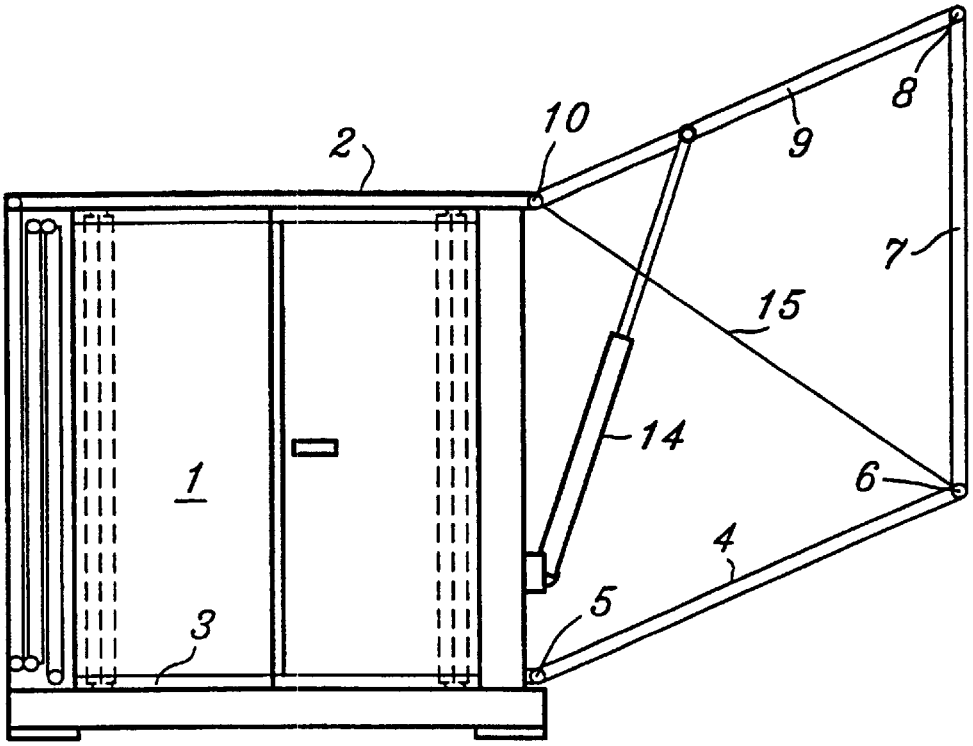
Figure 6:
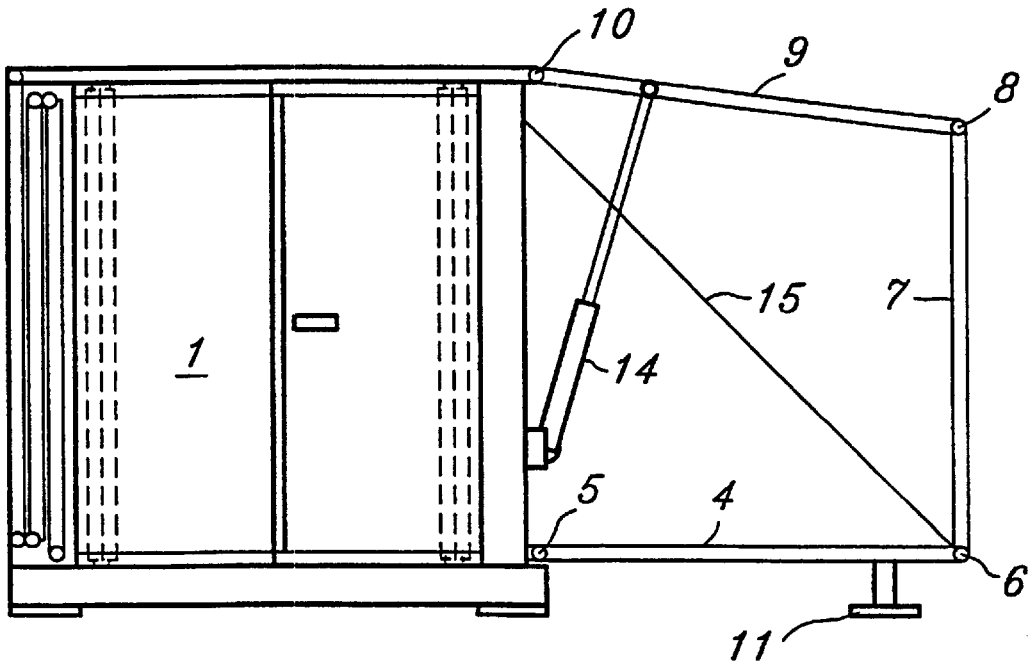

The side wall 7 and roof panel 9 are pivoted in a suitable way outwards and upwards by a gas spring means 14 or a hydraulic or pneumatic cylinder attached to the farthest end wall of the central structure and acting upon the roof panel 9, as disclosed by FIGS. 2, 3 and 4, until they are directed almost straight upwards, in which position the floor panel 4 and the side wall 7 can be pulled outwards and downwards, as disclosed by FIGS. 5 and 6 until the floor panel is in a horizontal position resting on a ground support. To retard the downward motion and to facilitate the lifting of the floor panel 4 and the side wall 7 at a subsequent change of the accommodation structure back into the non-expanded state, one or a pair of gas spring means 14 acting between the central structure and the roof panel 9 is sufficient in combination with a certain manual operation and a lifting support from a draw rope 15, e.g. a wire or chain, which is attached to the outermost end of the floor panel and is arranged to extend to the vicinity of the pivotal joint 10 of the roof panel 9 to the central structure, as shown in FIGS. 4–7, where the rope suitably is wound up on a wheel 16. A completely automatic control of the operation may be achieved by a hydraulic or pneumatic cylinder in combination with the draw rope 15.

The change from the expanded state according to FIG. 6 to the non-expanded state according to FIG. 1 is obviously achieved in opposite sequence according to FIGS. 5 to 2.

Figure 7:
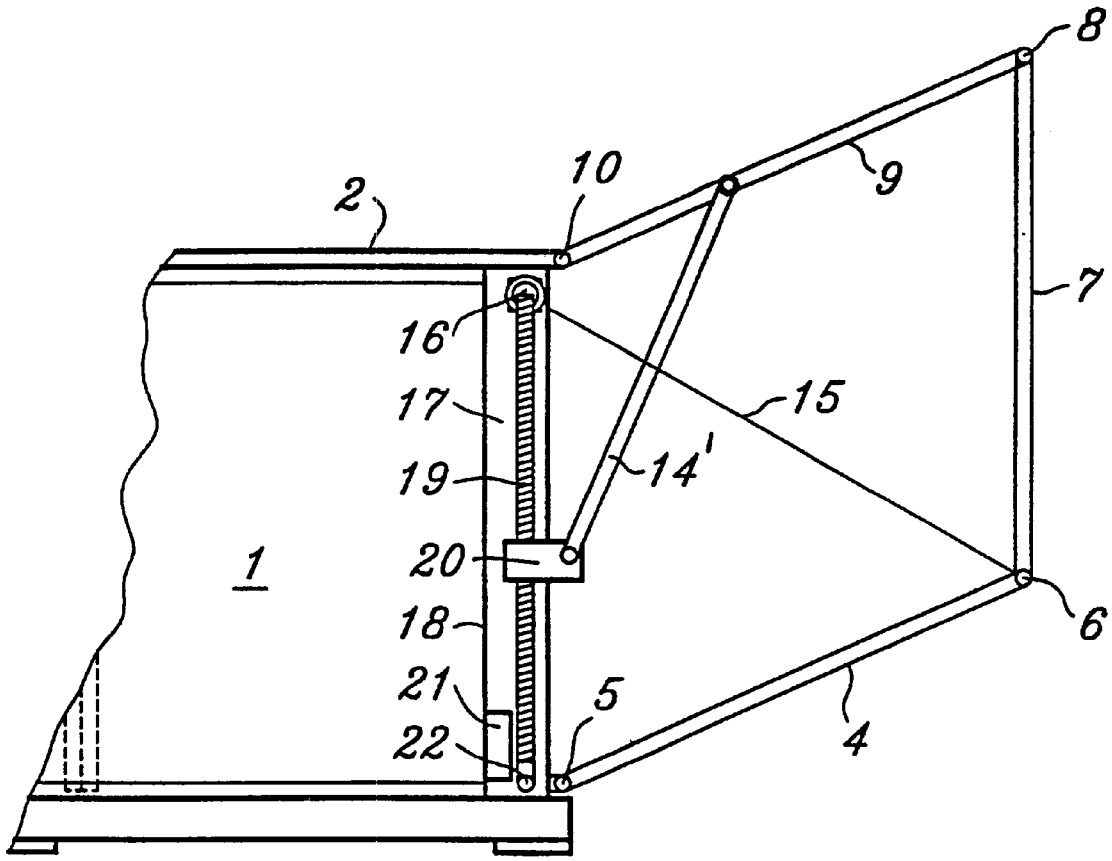
FIG. 7 is the same end view of an alternative actuating means.

As an alternative to hydraulic and pneumatic cylinders, a rod 14' can be used, the bottom of which may be journalled in a vertically movable screw or crank mechanism 17, as disclosed by FIG. 7. In that case a corner column 18 of the central structure is provided with a vertically journalled screw 19 having a nut 20 to which the bottom end of the rod 14' is hinged. The bottom end of the screw may be driven by an electric motor 21 via a worm gear 22 such that the nut 20 is moved up or down depending on the direction of rotation of the motor.

No ground support 11 is necessary if the draw rope is provided with a stop member in the expanded position shown in FIG. 6.

The central structure may also be suitably expandable in the shown way on the other side of the central structure.

In addition, two outwards pivotal front and rear side walls 12 and 13, respectively, are pivoted to the front and rear end walls 1, respectively, of the central structure. In the non-expanded state they can be directed in parallel to the longitudinal direction of the central structure.

What is claimed is:

1. An expandable, mobile accommodation structure comprising:

a central structure comprising a floor, a roof, front and rear end walls, and at least one longitudinal side wall that is movable out from the central structure from a non-expanded state to an expanded state to create an expanded accommodation;

rigid floor and roof panels that are each connected by respective hinges to both the central structure and to the longitudinal side wall; and front and rear side walls that are hinged to the central structure and pivotal outwards to close the expanded accommodation;

wherein the floor and roof panels are each dimensioned such that the longitudinal side wall is positioned essentially in a vertical position in the expanded state;

wherein a length of the roof panel between the hinge connecting the roof panel to the longitudinal side wall and the hinge connecting the roof panel to the central structure is at least equal to a height of the longitudinal side wall, so that the roof panel and the longitudinal side wall are permitted to hang down double-folded in the non-expanded state;

wherein one edge of at least one of the front and rear end walls of the central structure supports a rod member that exerts a lifting force to the roof panel during swinging up and down of the roof panel as the mobile accommodation structure is moved between the expanded and non-expanded states;

wherein an upper end of the rod member is pivoted to the roof panel and a bottom end of the rod member is journalled so as to be vertically movable by a vertically acting lifting mechanism; and wherein a draw rope member is attached to an outer end portion of the floor panel and extends to a vicinity of the hinge connecting the roof panel to the central structure.

2. An expandable, mobile accommodation structure comprising:

a central structure comprising a floor, a roof, front and rear end walls, and at least one rigid longitudinal side wall that is movable out from the central structure from a non-expanded state to an expanded state to create an expanded accommodation;

rigid floor and roof panels that are each connected by respective hinges to both the central structure and to the longitudinal side wall; and rigid front and rear side walls that are hinged to the central structure and pivotal outwards to close the expanded accommodation;

wherein the floor and roof panels are each dimensioned such that the longitudinal side wall is positioned essentially in a vertical position in the expanded state;

wherein a length of the roof panel between the hinge connecting the roof panel to the longitudinal side wall and the hinge connecting the roof panel to the central structure is at least equal to a height of the longitudinal side wall, so that the roof panel and the longitudinal side wall are permitted to hang down double-folded outside the floor panel in the non-expanded state;

wherein one edge of at least one of the front and rear end walls of the central structure supports an actuating means for exerting a lifting force to the roof panel so as to lift the roof panel to a most upright position at which the longitudinal side wall and the floor panel are arranged substantially in line with each other, during swinging up and down of the roof panel as the mobile accommodation structure is moved between the expanded and non-expanded states; and wherein a draw rope member, extending between a point close to the hinge connecting the floor panel to the longitudinal side wall and a point close to the hinge connecting the roof panel to the central structure, is provided for preventing the floor panel and the longitudinal side wall from being thrown outward when the mobile accommodation structure is moved from the non-expanded state to the expanded state and for drawing the floor panel toward the central structure when the mobile accommodation structure is moved from the expanded state back into the non-expanded state.

3. The structure according to claim 2, wherein the actuating means comprises a gas spring mechanism.

4. The structure according to claim 2, wherein the actuating means comprises one of a hydraulic and pneumatic cylinder.

5. The structure according to claim 2, wherein the actuating means a rod member, and wherein an upper end of the rod member is pivoted to the roof panel and a bottom end of the rod member is journalled so as to be vertically movable by one of a vertically acting screw and crank mechanism.

6. The structure according to claim 2, wherein the draw rope member is adapted to be wound onto and off a wheel.

7. The structure according to claim 6, wherein winding of the draw rope member is adapted to be at least partly assisted by one of a spring force and a crank mechanism.

8. The structure according to claim 2, wherein two longitudinal side wall and two sets of floor and roof sections are provided, and wherein the structure is expandable in two opposite directions.

9. The structure according to claim 2, wherein in the non-expanded state, the front and rear side walls are positioned in parallel to a longitudinal direction of the central structure inside the floor section, the longitudinal side wall and the roof section.

* * * * *